US006462336B1

(12) United States Patent
Bajic

(10) Patent No.: US 6,462,336 B1
(45) Date of Patent: Oct. 8, 2002

(54) ION SOURCE FOR A MASS ANALYZER AND METHOD OF PROVIDING A SOURCE OF IONS FOR ANALYSIS

(75) Inventor: Stevan Bajic, Sale (GB)

(73) Assignee: Masslab Limited (GB)

( * ) Notice: Subject to any disclaimer, the term of this patent is extended or adjusted under 35 U.S.C. 154(b) by 0 days.

(21) Appl. No.: 09/214,359

(22) PCT Filed: Apr. 28, 1998

(86) PCT No.: PCT/GB98/01232

§ 371 (c)(1),
(2), (4) Date: Sep. 16, 1999

(87) PCT Pub. No.: WO98/49710

PCT Pub. Date: Nov. 5, 1998

(30) Foreign Application Priority Data

Apr. 29, 1997 (GB) ..... 9708715

(51) Int. Cl.[7] ..... H01J 49/10
(52) U.S. Cl. ..... 250/288; 250/281; 250/282
(58) Field of Search ..... 250/288, 281, 250/282

(56) References Cited

U.S. PATENT DOCUMENTS

| | | | | |
|---|---|---|---|---|
| 4,769,540 A | | 9/1988 | Mitsui et al. | 250/288 |
| 4,861,988 A | | 8/1989 | Henion et al. | 250/288 |
| 4,999,493 A | | 3/1991 | Allen et al. | 250/288 |
| 5,070,240 A | | 12/1991 | Lee et al. | 250/288 |
| 5,171,990 A | | 12/1992 | Mylchreest et al. | 250/288 |
| 5,349,186 A | * | 9/1994 | Ikonomou et al. | 250/288 |
| 5,495,108 A | | 2/1996 | Appffel, Jr. et al. | 250/288 |
| 5,753,910 A | * | 5/1998 | Gourley et al. | 250/288 |

FOREIGN PATENT DOCUMENTS

| | | | |
|---|---|---|---|
| EP | 015311 3 A2 | 8/1985 | H01J/49/04 |
| GB | 2225159 A | 5/1990 | |
| GB | 2256523 A | 9/1992 | |
| GB | 2256523 A | 12/1992 | H01J/49/10 |
| GB | 2289569 A | 11/1995 | |
| WO | WO 96/15547 | 5/1996 | H01J/49/10 |

OTHER PUBLICATIONS

Van der Hoeven, et al., "Performance of an Electrospray–Interfaced Thermospray Ion Source in Hyphenated Techniques," Journal of Chromatography A, vol. 712, No. 1, Sep. 29, 1995, pp. 211–218.

* cited by examiner

*Primary Examiner*—Bruce Anderson
*Assistant Examiner*—Nikita Wells
(74) *Attorney, Agent, or Firm*—Haynes and Boone, LLP

(57) ABSTRACT

An ion source for a mass spectrometer operating at a low pressure has an atmospheric pressure sample ioniser which provides a sample flow containing desired sample ions. These ions are usually entrained with undesired gas and droplets. An interface chamber is held by a vacuum pump at a pressure between atmospheric and the operating pressure of the mass spectrometer. Sample ions with entrained gas are collected through an entrance orifice forming a stream of gas into the interface chamber. Sample ions exit the interface chamber through an exit orifice to the mass spectrometer. The interface chamber disrupts the stream of gas entering the interface chamber to provide a dead region having no net gas flow direction and the exit orifice is located in this dead region. The exit orifice should have no line of sight path to the entrance orifice or should be at least 30° off the flow axis of the stream entering the interface chamber through the entrance orifice. A flow disrupting pin is located in the interface chamber to disrupt the flow of the stream of gas entering through the entrance orifice.

44 Claims, 3 Drawing Sheets

Figure 1:
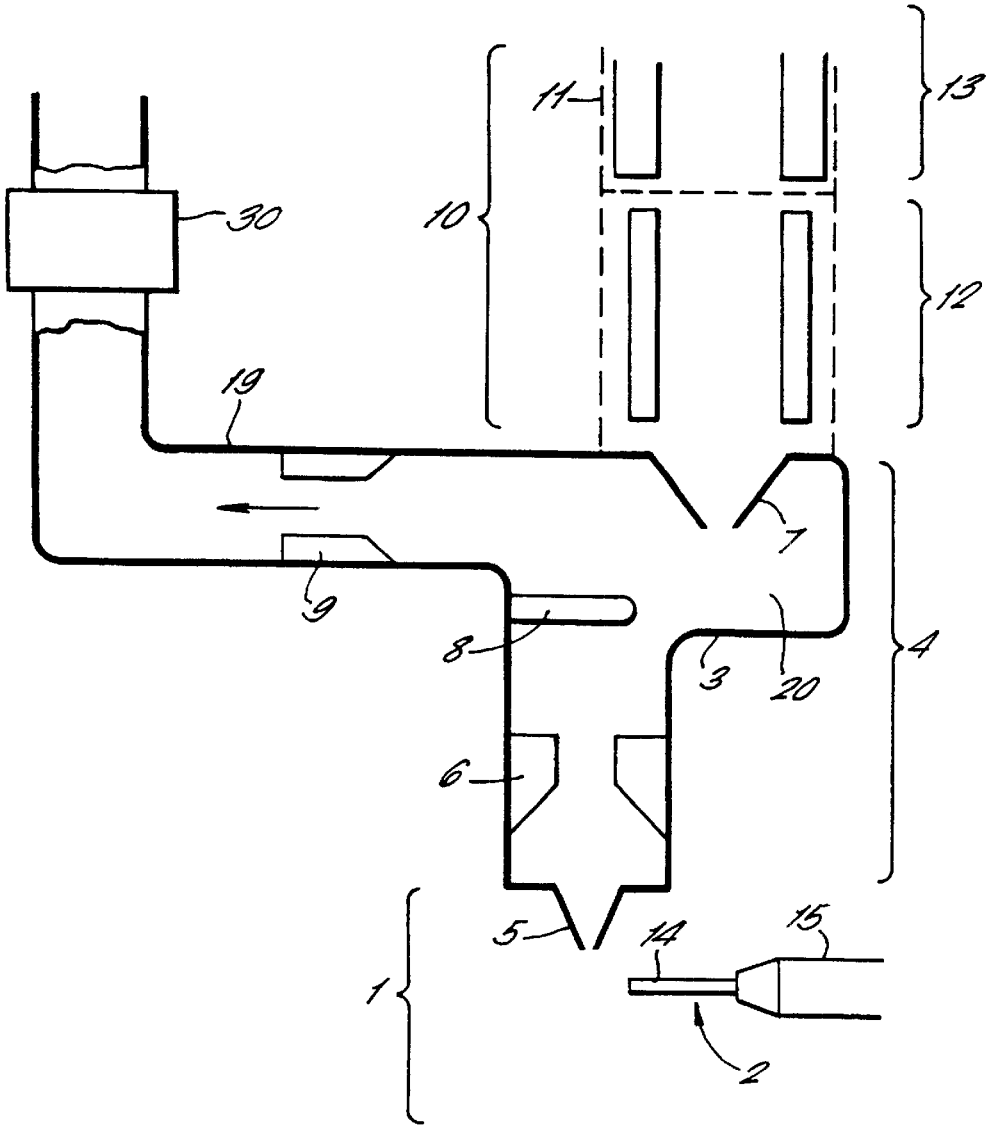

ION SOURCE FOR A MASS ANALYZER AND METHOD OF PROVIDING A SOURCE OF IONS FOR ANALYSIS

The invention relates to an ion source for a mass spectrometer and to a method of providing a source of ions for analysis. Mass spectrometers normally operate at low pressure and the present invention is particularly concerned with an ion source which operates at atmospheric pressure. Such ion sources include electrospray ion sources and atmospheric pressure chemical ionisation (APCI) ion sources.

Mass spectrometers have been used to analyse a wide range of materials, including organic substances, such as pharmaceutical compounds, environmental compounds and biomolecules. For mass analysis, it is necessary to produce ions of such sample compounds and biomolecules. Of particular use in the study of biological substances are mass spectrometers which have ion sources for creating ions of the sample compounds, where such ion sources operate at atmospheric pressure.

One such ion source is the electrospray ionisation (ESI) source which typically consists of a small tube or capillary through which a sample liquid is flowed. The sample liquid comprises the sample compounds and molecules to be analysed contained in a solvent. The capillary is maintained at a high potential difference relative to an adjacent surface. The liquid emerges from the tube and disperses into fine ionised droplets as a consequence of the high electric field at the tip of the capillary. The droplets are then desolvated by heating them to evaporate the solvent. Eventually, the ionised droplets become so small that they are unstable, whereupon they vaporise to form gaseous sample ions.

Another form of atmospheric pressure ion source is the atmospheric pressure chemical ionisation (APCI) ion source which uses a heated nebulizer to convert droplets of sample solution into the gaseous phase before ionisation. A corona discharge electrode is located adjacent to the nebulizer outlet. This ionises the surrounding gas and the nebulized solvent molecules. Since sample molecules generally have greater proton affinity than solvent molecules, collisions between them result in preferential ionisation of the sample molecules. In this way, gaseous sample ions are produced. ESI and APCI are complementary techniques, in that ESI is limited to charged or polar compounds, whereas APCI can be used for less polar compounds.

One problem with any technique involving droplets of sample solution is that despite the use of desolvation techniques, undesolvated droplets, dust and neutrals can enter the spectrometer producing a noise signal at the detector. Such particles can be prevented from entering the vacuum system of the mass spectrometer by, for example, using an opposing flow of dry gas ( e.g. nitrogen). However this solution is cumbersome and complex and involves the provision of a gas flow system and a supply of expensive pure gas.

Another approach is shown in U.S. Pat. No. 5,171,990, which shows an electrospray ion source in which the spray is directed off axis so that undesolvated ions do not enter the vacuum system. Similarly, U.S. Pat. No. 4,861,988 shows an electrospray ion source wherein the axis of the spraying capillary is offset from the axis of the sampling orifice to prevent sampling of large cluster ions.

U.S. Pat. No. 5,495,108 shows an electrospray/APCI mass spectrometer with orthogonal sampling to reduce vapour in the vacuum system and resultant noise. The spray is directed transversely across the sampling orifice, desolvated ions being electrostatically attracted into the mass spectrometer while solvent vapour and undesolvated ions to not enter the spectrometer region.

Van der Hoeven et al in J. Chromatog. A Vol. 712 (1995) pp. 211–218 discuss an electrospray interface adapted from a thermospray source, in which the longitudinal axis of the electrospray needle assembly, the entrance to the electrospray interface and the outlet to the vacuum pump which evacuates the interface are disposed generally along a first axis, the longitudinal axis of the mass spectrometer forming a second axis which is disposed transversely to the first axis, an electrostatic repeller electrode also being disposed along the second axis and directly opposite the entrance to the mass spectrometer. Neutrals and undesolvated ions should therefore tend to be evacuated directly by the pump, only required desolvated ions tending to be repelled into the mass spectrometer.

A disadvantage of any ion source system (such as U.S. Pat. Nos. 5,171,990 and 4,861,988) in which the sprayed sample is directed generally towards the spectrometer entrance, and there is a line of sight path between the location of ion generation and the entrance, is that some undesired particles can still enter the spectrometer. A further problem associated with line of sight sources is that of streaming. This is a consequence of the fluid dynamics of the system. When a gas flows through an aperture from an area of high pressure into an area of low pressure, a so called "Zone of silence" forms around and downstream of the aperture. Inside this zone the gas molecules acquire a high velocity, the molecules following straight streamlines with the highest intensity being along the aperture axis. The closer the spectrometer entrance is to this axis, such as in a line of sight source, the more gas will stream through directly into the spectrometer, increasing the load on the vacuum system within the spectrometer.

On the other hand, in those systems, (e.g. Van der Hoeven et al) in which the sample ions are directly generally transversely to the spectrometer entrance, an electrostatic repeller is required to deflect desolvated ions into the Sass spectrometer.

In one aspect, the present invention provides an ion source for a mass spectrometer which operates at a low pressure comprising an atmospheric pressure sample ioniser operative at atmospheric pressure to provide a sample flow containing desired sample ions entrained with undesired gas and droplets, an interface chamber having an evacuation port, and a vacuum pump connected to the evacuator port to hold the interface chamber at a pressure intermediate atmospheric pressure and the operating pressure of the mass spectrometer, the interface chamber having an entrance orifice located to collect desired sample ions with entrained gas and droplets into the interface clamber from said sample flow of said sample ioniser said entrance orifice having a flow axis and forming a stream of gas into said interface chamber along said flow axis, and an exit orifice for sample ions to exit the interface chamber to the mass spectrometer, wherein the interface chamber is arranged to disrupt said stream of gas to provide a dead region within said chamber of no net gas flow direction and said exit orifice is located in said dead region.

Preferably, the interface chamber has a flow disrupting surface intersecting the flow axis of the entrance orifice. Then the interface channel may form a flow channel between the entrance orifice and the evacuation port and said flow disrupting surface is provided by a flow disrupting member in said flow channel.

The invention also provides an ion source for a mass spectrometer which operates at low pressure comprising an atmospheric pressure sample ioniser operative at atmospheric pressure to provide a sample flow containing desired sample ions entrained with undesired gas and droplets, an interface chamber having an evacuation port, and a vacuum pump connected to the evacuation port to hold the interface chamber at a pressure intermediate atmospheric pressure and the operating pressure of the mass spectrometer, the interface chamber having an entrance orifice located to collect desired sample ions with entrained gas and droplets into the interface chamber from said sample flow of said sample ioniser and an exit orifice for sample ions to exit the interface chamber to the mass spectrometer, wherein there is no line of sight path in the interface chamber between the entrance orifice and the exit orifice. Alternatively, the exit orifice may be in line of sight with said entrance orifice, wherein the line of sight is at least 30° to said flow axis of the entrance aperture. Then, the entrance orifice may have a flow axis and form a stream of gas into said interface chamber along said flow axis, and the interface chamber may include flow disrupting means to disrupt said stream of gas to provide a dead region within said chamber of no net gas flow direction, said exit orifice being located in said dead region. Also, said interface chamber may form a flow channel between the entrance orifice and the evacuation port.

In a further aspect, she present invention provides an ion source for a mass spectrometer which operates at low pressure, comprising an atmospheric pressure sample ioniser operative at atmospheric pressure to provide a sample flow containing desired sample ions entrained with undesired gas and droplets, an interface chamber having an evacuation port, and a vacuum pump connected to the evacuation port to hold the interface chamber at a pressure intermediate atmospheric pressure and the operating pressure of the mass spectrometer, the interface chamber having an entrance orifice located to collect desired sample ions with entrained gas and droplets into the interface chamber from said sample flow of said sample ioniser, and an exit orifice for sample ions to exit the interface chamber to the mass spectrometer, the interface chamber defining a flow channel between the entrance orifice and the evacuation port, wherein the exit orifice is located out of said flow channel.

Preferably, the interface chamber further forms a side chamber to one side of said flow channel, said chamber containing a dead region in which there is no net gas flow direction, and said exit orifice is located in said side chamber to collect sample ions from said region.

In a still further aspect, the invention also provides an ion source for a mass spectrometer which operates at low pressure, comprising an atmospheric pressure sample ioniser operative at atmospheric pressure to provide a sample flow containing desired sample ions entrained with undesired gas and droplets, an interface chamber having an evacuation port, and a vacuum pump connected to the evacuation port to hold the interface chamber at a pressure intermediate atmospheric pressure and the operating pressure of the mass spectrometer, the interface chamber having an entrance orifice located to collect desired sample ions with entrained gas and droplets into the interface chamber from said sample flow of said sample ioniser, an exit orifice for sample ions to exit the interface chamber to the mass spectrometer, and flow splitting means arranged to favour the collection of sample ions from the interface chamber by said exit orifice, wherein said flow splitting means comprises means providing in said interface chamber a dead region of no net gas flow direction, said exit orifice being located in said dead region.

Preferably, the interface chamber defines a flow channel between the entrance orifice and the evacuation port and said flow splitting means comprises a side chamber in said interface chamber, said side chamber being located to one side of said flow channel and containing said dead region.

In preferred examples, the ion source includes a flow disrupting member in said flow channel.

Indeed, in a yet further aspect the present invention provides an ion source for a mass spectrometer which operates at low pressure comprising an atmospheric pressure sample ioniser operative at atmospheric pressure to provide a sample flow containing desired sample ions entrained with undesired gas and droplets, an interface chamber having an evacuation port, and a vacuum pump connected to the evacuation port to hold the interface chamber at a pressure intermediate atmospheric pressure and the operating pressure of the mass spectrometer, the interface chamber having an entrance orifice located to collect desired sample ions with entrained gas and droplets into the interface chamber from said sample flow of said sample ioniser, said entrance orifice having a flow axis, and an exit orifice for sample ions to exit the interface chamber to the mass spectrometer, the interface chamber defining a flow channel between the entrance orifice and the evacuation port, wherein the ion source includes a flow disrupting member in said flow channel to create a dead region of no net gas flow direction in the interface chamber, and the exit orifice is located to be spaced from said flow axis of the entrance orifice to collect sample ions from said dead region.

Preferably, said interface chamber further forms a side chamber to one side of said flow channel, said dead region extending into said side chamber and said exit orifice being located in said side chamber.

It is normal practice to include an interface chamber between the atmospheric pressure region in which sample ions are produced and the low pressure chamber of the mass spectrometer itself. The interface chamber is strongly pumped to keep the pressure of the interface chamber relatively low (but higher than the mass spectrometer pressure) and to relieve the load on the evacuation system of the mass spectrometer.

Because of the substantial pressure difference between the atmospheric pressure region and the interior of the interface chamber, the gas with sample ions entering the chamber forms a high velocity jet immediately inside the entrance interface. This in turn forms a stream or flow of gas within the interface chamber substantially along the flow axis of the entrance orifice. By arranging for the exit orifice of the interface chamber to be in a dead region of the chamber where there is no net gas flow, or at least well out of the flow channel between the entrance orifice and the evacuation port of the interface chamber, the tendency of larger droplets and other particles entrained with the incoming gas to pass directly through the exit orifice and on through the mass spectrometer to the ion detector, is greatly reduced if not eliminated. The presence of means to disrupt the incoming flow of gas into the interface chamber can enhance the presence of sample ions in the dead region, thereby improving the sensitivity of the instrument.

The flow disrupting member may comprise a pin projecting into said flow channel. The pin may have a transverse dimension perpendicular to the flow channel which is greater than the aperture size of the entrance orifice.

The source may include a flow restrictor disposed in the flow channel between the entrance orifice and the disrupting member. There may also be flow control means to control the rate of flow from the interface chamber through the evacuation port.

The flow disrupting member is provided to disrupt the streamlined flow of gas from the entrance aperture of the interface chamber and to ensure distribution of the ions entering the interface chamber throughout the volume of the chamber, and especially in the dead region within the interface chamber from which sample ions are drawn through the exit orifice into the mass spectrometer.

Importantly, the entire interface chamber, including not only the entrance and exit orifices, but also the flow disrupting member, is preferably held at the same electric potential, so that there is no acceleration of ions within the interface chamber. Ions flow from the interface chamber into the mass spectrometer due to the pressure differential between the interface chamber and the lower pressure spectrometer chamber. Because the exit aperture is located in a part of the interface chamber where there is no organised flow of gas, the ions and any neutral molecules and particles enter the spectrometer region through the exit aperture of the interface chamber at thermal energies.

The arrangement of the interface chamber and the disrupting member may be such as to minimise the proportion of undesolvated droplet ions and unwanted cluster ions in the region of the interface chamber from which sample ions are drawn through the exit is aperture. However, any neutrals or undesolvated droplets entering the mass spectrometer through the exit orifice, do so with no substantial net velocity, and so the probability of any such neutral or droplet proceeding through the spectrometer to the ion detector is very much reduced.

Further, unwanted cluster ions entering the mass spectrometer through the exit orifice, experience an accelerating electric field. Because of the reduced pressure, and the increased mean free path in the mass spectrometer region, the accelerated cluster ions experience energetic collisions in this region sufficient to break up the clusters.

Preferably, said entrance orifice has a first flow axis and said exit orifice has a second flow axis, and said first and second flow axes are spaced apart and arranged so as not to intersect within the interface chamber. This arrangement minimises the possibility of direct flight paths from the entrance orifice to the exit orifice of the interface chamber.

Conveniently, said first and second flow axes are parallel.

In preferred arrangements, there is no line of sight path in the interface chamber between the entrance orifice and the exit orifice.

The invention also provides a method of providing a source of ions for mass analysis of desired sample ions at a low mass analysis pressure, comprising the steps of forming a sample flow at atmospheric pressure containing desired sample ions entrained with undesired gas and droplets, skimming desired sample ions with entrained gas and droplets from said sample flow into an interface chamber evacuated to an intermediate pressure below atmospheric and above the mass analysis pressure, providing in said interface chamber a region of stagnant or turbulent gas flow, and skimming desired sample ions from said region for mass analysis.

Figure 2:
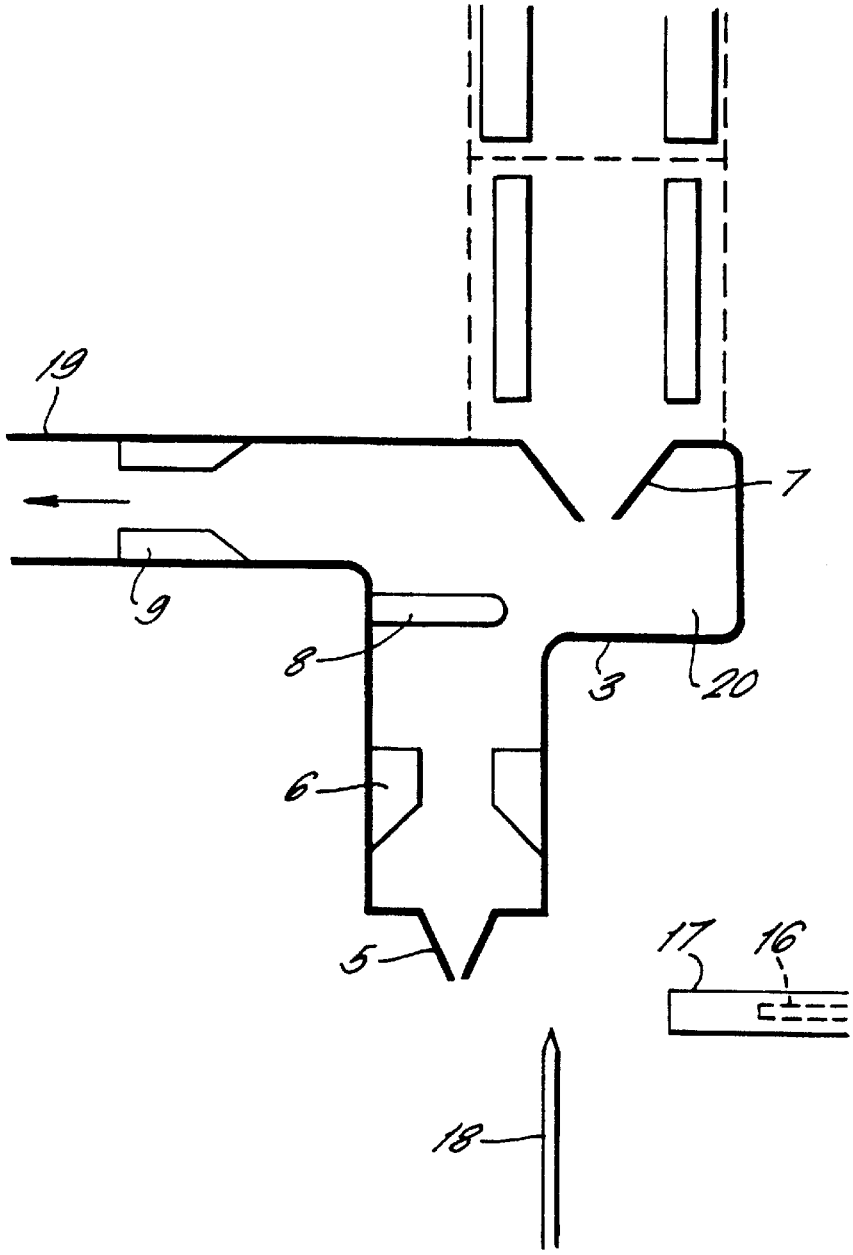
Figure 3:
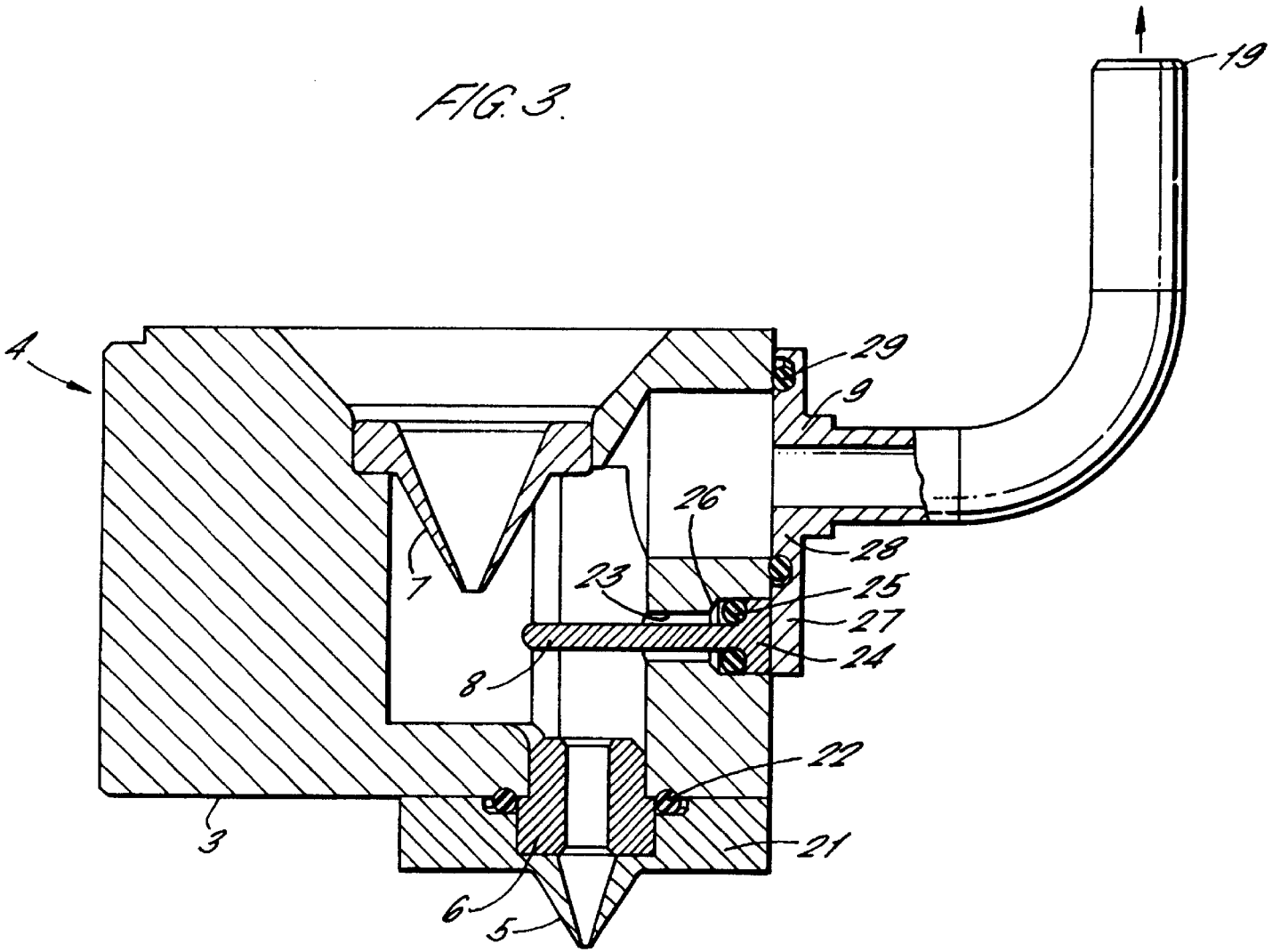

Certain preferred embodiments of the invention will now be described in detail by way of example only and with reference to the figures, wherein:

FIG. 1 is a schematic diagram of an ion source and mass spectrometer embodying the invention and using an electrospray probe, FIG. 2 is a schematic diagram of an ion source and mass spectrometer embodying the invention and using an APCI probe, and FIG. 3 is a cross-sectional view of an ion source interface for use in a preferred embodiment of the invention.

FIG. 1, an ion source includes an ionisation region 1 at atmospheric pressure, which contains an electrospray probe 2 arranged to produce ionised sample droplets. A housing 3 defines an ion source interface region 4 which is in communication with the ionisation region 1 via an entrance orifice 5. The interface region is evacuated via a port 19 by conventional vacuum pump 30 (typically a 28 $m^3$/hr rotary pump) to a pressure of typically 15 mBar. The sample flow, which includes gaseous sample ions and may also include gaseous solvent molecules and neutrals passes through the entrance orifice 5 and enters the interface region 4.

The sample flow having entered the interface housing then passes through an entrance flow restrictor 6.

The interface region shown in FIG. 1 is generally T-shaped, so that the sample flow having travelled up the "leg" of the T is split. The greater proportion of the flow passes into one arm of the T towards the vacuum outlet 19. The other arm of the T contains an exit orifice 7, typically 1 mm in diameter. This segment 20 of the T forms a "dead volume" in which the gas flow is substantially stagnant or turbulent, so that the velocity of the sample ions and any other molecules or particles within this segment is low and has no net direction. This increases the probability that sample ions will enter the mass spectrometer and decreases the likelihood of unwanted molecules and particles penetrating through the mass spectrometer to influence the ion detection signal. Furthermore, a disruptor pin 8 protrudes into the sample flow in the "leg" of the T. This disrupts the said sample flow which would otherwise tend to bypass the segment 20 of the interface chamber, and causes an increase in the number of sample ions in the segment 20 which can be drawn through the exit orifice 7.

The axes of the entrance orifice 5 and the exit orifice 7 are substantially parallel, but are displaced, typically by a distance of approximately 10 mm. Also, the interface chamber 3 provides no line of sight path between the entrance and exit orifices 5 and 7. With the above described arrangement, ions and other gas molecules or particles cannot stream directly from the entrance orifice 5 to the exit orifice 7. Sample ions pass through the exit orifice 7 at relatively low flow velocity.

An exit flow restrictor 9 is also placed in the exit segment of the interface region, adjacent to the evacuation port.

The exit orifice 7 serves to communicate between the interface region 4 and a spectrometer region 10 (typically including a conventional quadrupole or magnetic sector mass spectrometer) which may consist of a housing (shown dotted as 11) defining an RF lens region 12 typically evacuated to around $6\times10^{-3}$ mBar, a mass analyser region 13 typically evacuated to around $8\times10^{-5}$ mBar and other conventional elements, which are not shown such as an ion detector etc.

The mean free path of the ions increases on passing from the interface region to the low pressure region after the exit orifice, where the ions can be accelerated by means of the potential (typically 0–100V) applied to the interface housing 3. At high voltages, greater than 40V say, significant ion fragmentation can occur if required for structure elucidation. Cluster ions passing through the exit orifice 7 are also declustered in the region. However the probability of unwanted neutrals passing from the region 20 through the exit orifice 7 and reaching the ion detector is much reduced, because of the reduced velocity and random flow of the gas in the region 20.

It should be noted that in this example, all elements of the interface chamber, including not only the entrance orifice cone 5 and the exit orifice cone 7, but also the disrupting pin 8 are at the same electric potential. The pin 8 operates aerodynamically on the gas flow entering the chamber 3, to encourage a "chaotic" flow of gas and desired sample ions to fill the region 20 from which sample ions can pass through the exit aperture 7.

The ion source of FIG. 1 is an electrospray ion source, which comprises a capillary tube 14 held at a high potential (typically around 3 kV) relative to the interface housing, and a nebulizer heater 15, which is required to desolvate the sample droplets. FIG. 2 is similar to FIG. 1 except that it shows an APCI ion source. Visible in FIG. 2 are the APCI nebulizer capillary 16 (which can be, for example, of the pneumatic nebulizer type) the heater 17 and a corona discharge electrode 18. The entire block or housing 3 may be heated by means which are not shown, in order to assist in desolvating sample droplets and to prevent solvent coating the surfaces of the housing and blocking the entrance and exit orifices.

FIG. 3 shows a cross section of a form of the interface region 4 for use in a preferred embodiment of the invention. As before, the block or housing 3 (typically of stainless steel) defines the ion source interface. The entrance orifice 5 is formed of an apertured hollow cone, also typically of stainless steel.

The entrance flow restrictor 6 is positioned in the sample flow path downstream of the entrance orifice. The exit flow restrictor 9 is provided in the exhaust gas path and may comprise a length of connecting tube of selected internal diameter. It has been found that both the size of the aperture in the entrance orifice and the dimensions (bore and length) of the entrance flow restrictor has a marked effect on the sensitivity of the device, and also on the ion energy spread. The choice of these various dimensions may require a compromise between sensitivity and ion energy spread. It is found that an entrance restrictor of length 12 mm and internal diameter 2 mm gives high sensitivity and a desirable ion energy spread of less than 1 volt. In contrast, the exit flow restrictor is found to have no significant effect on ion energy spread. However, this restrictor affects the sensitivity of the device and is typically a cylindrical bore of length 80 mm and internal diameter 4 mm.

Returning to FIG. 3, the flow disrupter 8 protrudes into the sample flow path downstream from the flow restrictor but still within the "leg" of the generally T-shaped interface region. The disrupter pin is typically manufactured from stainless steel; the degree to which it protrudes is fixed. It has been found that the performance of the device improves if the disrupter pin protrudes over halfway into the sample flow. The disrupter pin (which is typically around 1.6 mm in diameter) should protrude so as to "cover" (although laterally spaced from) the entrance orifice, which is typically 0.4 mm in diameter.

It must be noted that the advantages given by the invention, including the avoidance of streaming, allow orifices to be used that are significantly larger than those normally contemplated in such a source. This increases the sensitivity and robustness of the device a large orifice is less likely to be blocked, e.g. by involatile buffers. The sample to be analysed may typically be LC column eluent.

At the top of the "T" the sample flow path splits one arm extending towards the evacuation port 19 and the other arm having in it the exit orifice 7, again formed as a stainless steel cone, which communicates with the spectrometer region. Conveniently, the spectrometer may be an RF lens system followed by a quadrupole mass analyser. The spectrometer part of the system is conventional and will not be described in detail here.

The flow restrictor 6 is located and clamped in position by a flange 21 supporting the entrance orifice cone 5, which is in turn fastened to the housing block 3 by two securing screws (not shown). A good seal between the interior of the housing and the flange 21 is ensured by a deformable O-ring 22 located in an annular recess of the flange 21. The disruptor pin 8 is located to extend through a bore 23 through a wall of the housing block 3. The pin 8 has an enlarged head 24 which fits in a counter sink portion of the bore 23. An O-ring 25 forms a good seal between the inner face of the head 24 of the pin and a facing shoulder 26 at the base of the counter sink portion of the bore 23. The pin 8 is clamped in position behind an extended part 27 of a connecting flange 28 formed on the connecting tube forming the exit flow restrictor 9. The flange 28 is fastened to the housing block 3 by two or more bolts (not shown). An O-ring 29 forms a good seal between the flange 28 and the block 3.

As illustrated in FIG. 1, the electrospray probe 2 produces an initial spray of ionised molecules and particles which is directed generally transversely of the flow axis of the entrance orifice 5. The spray forms a cone diverging from the capillary 14 and the entrance orifice 5 of the interface chamber 26 is located to suck ions (and other particles) from the edge of the cone which is a region of the spray which has relatively high ion density. A similar arrangement is used for the APCI ion generator of FIG. 2.

It is important to note that the disrupter pin is held at the same potential as the interface housing. The pin therefore has no electrostatic repulsion effect on the sample ions, rather it has a mechanical effect in that it disrupts the sample flow. Since all the source components including the disrupter pin are metallic and held at the same potential as the interface block or housing, it is not necessary to provide a separate voltage source or circuitry for the disrupter pin, which simplifies construction and maintenance. The described source has many further advantages in that it is robust, highly sensitive, able to cope with both high and low flow rates, compact, reliable, economical in its manufacture, easy to tune, user-friendly and adaptable.

In the arrangements illustrated in the drawings a disrupter pin is used, extending into the flow stream of incoming gas through the entrance orifice of the interface chamber. This pin ensures a substantial region is formed in the interface chamber which has no net gas flow direction, and in which gas flow velocity is reduced and the ions are at thermal energies. The exit orifice is provided in this region. Other geometries and arrangements may be used to provide the same effect. For example, the interface chamber may be shaped so that the incoming gas stream strikes a wall of the chamber. It will normally be important for the exit aperture to be well off, at least 30° from, the flow axis of the entrance chamber, or completely out of line of sight within the interface chamber.

It should also be noted that other forms of atmospheric pressure sample ioniser may be used with embodiments of the intention, in addition to the ESI and APCI devices disclosed.

What is claimed is:

1. An ion source for a mass spectrometer, the mass spectrometer being operable at a first, low pressure, the ion source comprising:

an atmospheric pressure sample ionizer operative at a second, atmospheric pressure, the ionizer being arranged to provide a sample flow containing desired sample ions entrained with undesired gas and droplets;

an interface chamber having an evacuation port; and a vacuum pump connected to the evacuation port so as to hold the said interface chamber at a third, intermediate pressure which is higher than the said first, low pressure at which the mass spectrometer operates, but lower than the said second, atmospheric pressure;

the interface chamber her comprising:

an entrance orifice located so as to receive the said sample flow into the said interface chamber, wherein the said entrance orifice has a flow axis and wherein the entrance orifice causes the sample flow to form a stream of gas along the said flow axis and into said interface chamber; and an exit orifice for sample ions to exit the said interface chamber to the said mass spectrometer;

wherein the interface chamber is arranged to disrupt said stream of gas to provide a dead region within said chamber, the dead region having no net gas flow direction and wherein said exit orifice is located in said dead region.

2. An ion source for a mass spectrometer as claimed in claim 1, wherein the interface chamber has a flow disrupting surface intersecting the flow axis of the entrance orifice.

3. An ion source for a mass spectrometer as claimed in claim 2, wherein the interface chamber forms a flow channel between the entrance orifice and the evacuation port and said flow disrupting surface is provided by a flow disrupting member in said flow.

4. An ion source for a mass spectrometer as claimed in claim 3, and including a flow restrictor disposed in the flow channel between the entrance orifice and the disrupting member.

5. An ion source for a mass spectrometer as claimed in claim 3, wherein said interface chamber further forms a side chamber to one side of said flow channel, said dead region extending into said side chamber, and said exit orifice being located in said side chamber.

6. An ion source for a mass spectrometer as claimed in claim 5, and including a flow restrictor disposed in the flow channel between the entrance orifice and the disrupting member.

7. An ion source for a mass spectrometer as claimed in claim 3, wherein said flow disrupting member comprises a pin projecting into said flow channel.

8. An ion source for a mass spectrometer as claimed in claim 7, and including a flow restrictor disposed in the flow channel between the entrance orifice and the disrupting member.

9. An ion source for a mass spectrometer as claimed in claim 7, wherein the pin has a transverse dimension perpendicular to the flow channel which is greater than the aperture size of the entrance orifice.

10. An ion source for a mass spectrometer as claimed in claim 9, and including a flow restrictor disposed in the flow channel between the entrance orifice and the disrupting member.

11. An ion source for a mass spectrometer as claimed in claim 1, and including flow control means to control the rate of flow from the interface chamber through the evacuation port.

12. An ion source for a mass spectrometer as claimed in claim 1, wherein said entrance orifice has a first flow axis and said exit orifice has a second flow axis, and said first and second flow axes are spaced apart and arranged so as not to intersect within the interface chamber.

13. An ion source for a mass spectrometer as claimed in claim 12, wherein said first and second flow axes are parallel.

14. An ion source for a mass spectrometer as claimed in claim 1, wherein there is no line of sight path in the interface chamber between the entrance orifice and the exit orifice.

15. An ion source for a mass spectrometer, the mass spectrometer being operable at a first, low pressure, the ion source comprising:

an atmospheric pressure sample ionizer operative at a second, atmospheric pressure, the ionizer being arranged to provide a sample flow containing desired sample ions entrained with undesired gas and droplets;

an interface chamber having an evacuation port, and a vacuum pump connected to the evacuation port so as to hold the said interface chamber at a third, intermediate pressure which is higher than the said first, low pressure at which the mass spectrometer operates, but lower than the said second, atmospheric pressure;

the interface chamber hirer comprising:

an entrance orifice located so as to receive the said sample flow into the said interface chamber, wherein the said entrance orifice has a flow axis and wherein the entrance orifice causes the sample flow to form a stream of gas along the said flow axis and into said interface chamber;

an exit orifice for sample ions to exit the said interface chamber to the said mass spectrometer; and flow splitting means arranged to cause the said sample ions, in preference, to leave the interface chamber via said exit orifice;

wherein said flow splitting means comprises means which provides in said interface chamber a dead region of no net gas flow direction, said exit orifice being located in said dead region.

16. An ion source for a mass spectrometer as claimed in claim 15, wherein the interface chamber defines a flow channel between the entrance orifice and the evacuation port and said flow splitting means comprises a side chamber in said interface chamber, said side chamber being located to one side of said flow channel and containing said dead region.

17. An ion source for a mass spectrometer as claimed in claim 16 and including a flow restrictor disposed in the flow channel between the entrance orifice and the disrupting member.

18. An ion source for a mass spectrometer as claimed in claim 16 and including a flow disrupting member in said flow channel.

19. An ion source for a mass spectrometer as claimed in claim 18 and including a flow restrictor disposed in the flow channel between the entrance orifice and the disrupting member.

20. An ion source for a mass spectrometer as claimed in claim 18 wherein said flow disrupting member comprises a pin projecting into said flow channel.

21. An ion source for a mass spectrometer as claimed in claim 20 and including a flow restrictor disposed in the flow channel between the entrance orifice and the disrupting member.

22. An ion source for a mass spectrometer as claimed in claim 20 wherein the pin has a transverse dimension perpendicular to the flow channel which is greater than the aperture size of the entrance orifice.

23. An ion source for a mass spectrometer as claimed in claim 22 it and including a flow restrictor disposed in the flow channel between the entrance orifice and the disrupting member.

24. An ion source for a mass spectrometer as claimed in claim 15, and including flow control means to control the rate of flow from the interface chamber through the evacuation port.

25. An ion source for a mass spectrometer as claimed in claim 15, wherein said entrance orifice has a first flow axis and said exit orifice has a second flow axis, and said first and second flow axes are spaced apart and arranged so as not to intersect within the interface chamber.

26. An ion source for a mass spectrometer as claimed in claim 25, wherein said first and second flow axes are parallel.

27. An ion source for a mass spectrometer as claimed in claim 15, wherein there is no line of sight path in the interface chamber between the entrance orifice and the exit orifice.

28. An ion source for a mass spectrometer, the mass spectrometer being operable at a first, low pressure, the ion source comprising;

an atmospheric pressure sample ionizer operative at a second, atmospheric pressure, the ionizer being arranged to provide a sample flow containing desired sample ions entrained with undesired gas and droplets;

an interface chamber having an evacuation port; and a vacuum pump connected to the evacuation port so as to hold the said interface chamber at a third, intermediate pressure which is higher than the said first, low pressure at which the mass spectrometer operates, but lower than the said second, atmospheric pressure;

the interface chamber further comprising:

an entrance orifice located so as to receive the said sample flow into the said interface chamber, wherein the said entrance orifice has a flow axis and wherein the entrance orifice causes the sample flow to form a stream of gas along the said flow axis and into said interface chamber; and an exit orifice for sample ions to exit the said interface chamber to the said mass spectrometer;

the interface chamber further defining a flow channel between the entrance orifice and the evacuation port;

wherein the ion source farther includes a flow disrupting member in said flow channel to create a dead region of no net gas flow direction in the interface chamber, and wherein the exit orifice is located to be spaced from said flow axis of the entrance orifice so as to collect sample ions from said dead region.

29. An ion source for a mass spectrometer as claimed in claim 28 and including a flow restrictor disposed in the flow channel between the entrance orifice and the disrupting member.

30. An ion source for a mass spectrometer as claimed in claim 28, wherein said flow disrupting member comprises a pin projecting into said flow channel.

31. An ion source for a mass spectrometer as claimed in claim 30 and including a flow restrictor disposed in the flow channel between the entrance orifice and the disrupting member.

32. An ion source for a mass spectrometer as claimed in claim 30, wherein the pin has a transverse dimension perpendicular to the flow channel which is greater than the aperture size of the entrance orifice.

33. An ion source for a mass spectrometer as claimed in claim 32 and including a flow restrictor disposed in the flow channel between the entrance orifice and the disrupting member.

34. An ion source for a mass spectrometer as claimed in claim 28, wherein said interface chamber further forms a side chamber to one side of said flow channel, said dead region extending into said side chamber, and said exit orifice being located in said side chamber.

35. An ion source for a mass spectrometer as claimed in claim 34 and including a flow restrictor disposed in the flow channel between the entrance orifice and the disrupting member.

36. An ion source for a mass spectrometer as claimed in claim 34, wherein said flow disrupting member comprises a pin projecting into said flow channel.

37. An ion source for a mass spectrometer as claimed in claim 36, and including a flow restrictor disposed in the flow channel between the entrance orifice and the disrupting member.

38. An ion source for a mass spectrometer as claimed in claim 36, wherein the pin has a transverse dimension perpendicular to the flow channel which is greater than the aperture size of the entrance orifice.

39. An ion source for a mass spectrometer as claimed in claim 36 and including a flow restrictor disposed in the flow channel between the entrance orifice and the disrupting member.

40. An ion source for a mass spectrometer as claimed in claim 28, and including flow control means to control the rate of flow from the interface chamber through the evacuation port.

41. An ion source for a mass spectrometer as claimed in claim 28, wherein said entrance orifice has a first flow axis and said exit orifice has a second flow axis, and said first and second flow axes are spaced apart and arranged so as not to intersect within the interface chamber.

42. An ion source for a mass spectrometer as claimed in claim 41 wherein said first and second flow axes are parallel.

43. An ion source for a mass spectrometer as claimed in claim 28, wherein there is no line of sight path in the interface chamber between the entrance orifice and the exit orifice.

44. A method of providing a source of ions for mass analysis of desired sample ions, the mass analysis occurring at a first low mass analysis pressure, the method comprising the steps of:

forming a sample flow at atmospheric pressure, the said sample flow containing desired sample ions entrained with undesired gas and droplets;

skimming desired sample ions, along with entrained gas and droplets from said sample flow, into an interface chamber evacuated to a second, intermediate pressure which is below atmospheric pressure but above the said second, low pressure at which mass analysis takes place; forming a stream of gas into said interface chamber;

disrupting said stream of gas in said interface chanter so as to provide a dead region within said chamber, said dead region having no net gas flow direction; and skimming desired sample ions from said dead region for mass analysis.

* * * * *

UNITED STATES PATENT AND TRADEMARK OFFICE

CERTIFICATE OF CORRECTION

PATENT NO. : 6,462,336 B1 
DATED : October 8, 2002
INVENTOR(S) : Stevan Bajic

It is certified that error appears in the above-identified patent and that said Letters Patent is hereby corrected as shown below:

Title page,
Item [57], ABSTRACT,
Line 2, delete "ioniser" and insert -- ionizer --

Column 1,
Line 11, delete "ionisation" and insert -- ionization --
Line 21, delete "ionisation" and insert -- ionization --
Line 25, delete "analysed" and insert -- analyzed --
Lines 28 and 31, delete "ionised" and insert -- ionized --
Lines 34 and 36, delete "ionisation" and insert -- ionization --
Line 38, delete "ionises" and insert -- ionizes --
Line 41, delete "ionisation" and insert -- ionization --

Column 2,
Line 38, delete "Sass" and insert -- mass --

Column 2, line 40 through Column 4, line 32,
Delete lines

Column 4,
Line 33, before "It", insert -- The present invention provides an ion source for a mass spectrometer. The ion source has an atmospheric pressure ionizer, an interface chamber and a vacuum pump. --
Line 37, after "pumped" and before "to", insert -- by the vacuum pump --
Lines 47 and 48, delete "By arranging for the exit orifice of the interface chamber to be in a dead" and insert -- The present invention provides, in one aspect, an exit orifice in a dead --
Line 51, delete "chamber, the tendency" and insert -- chamber. With this arrangement, the tendency --
Lines 55-58, delete "The presence of means to disrupt the incoming flow of gas into the interface chamber can enhance the presence of sample ions in the dead region, thereby improving the sensitivity of the instrument" and insert -- Another aspect of the invention provides means to disrupt the incoming flow of gas into the chamber. The presence of such means can enhance the presence of sample ions in the dead region, thereby improving the sensitivity of the instrument --

Column 5,
Line 15, delete "organised" and insert -- organized --
Line 20, delete "minimise" and insert -- minimize --
Line 35, delete "Preferably, said" and insert -- In another aspect of the invention, the --
Line 39, delete "minimises" and insert ---minimizes --
Lines 47, after "pressure" delete ", comprising" through line 56 and insert -- . --

UNITED STATES PATENT AND TRADEMARK OFFICE

CERTIFICATE OF CORRECTION

PATENT NO. : 6,462,336 B1
DATED : October 8, 2002
INVENTOR(S) : Stevan Bajic

It is certified that error appears in the above-identified patent and that said Letters Patent is hereby corrected as shown below:

Column 6,
Line 1, delete "ionisation and insert -- ionization --
Line 3, delete "ionised" and insert -- ionized --
Line 5, delete "ionisation" and insert -- ionization --

Column 7,
Line 58, delete "analysed" and insert -- analyzed --

Column 8,
Line 19, delete "ionised" and insert -- ionized --
Line 54, delete "ioniser" and insert -- ionizer --

Column 9,
Line 4, delete "her" and insert -- further --
Line 24, delete "flow." and insert -- flow channel. --

Column 10,
Line 14, delete "hirer" and insert -- further --

Column 11,
Line 36, delete "farther" and insert -- further --

Column 12,
Line 54, delete "chanter" and insert -- chamber --

Signed and Sealed this

Tenth Day of February, 2004

JON W. DUDAS
*Acting Director of the United States Patent and Trademark Office*